United States Patent [19]

Rotbart

[11] Patent Number: 4,599,597

[45] Date of Patent: Jul. 8, 1986

[54] CIRCUIT PROTECTION DEVICES

[75] Inventor: Guy Rotbart, Saint-Mande, France

[73] Assignee: Societe d'Exploitation Soremec-Chess, Rungis, France

[21] Appl. No.: 660,887

[22] Filed: Oct. 15, 1984

[30] Foreign Application Priority Data

Oct. 20, 1983 [FR] France ..... 83 16683
Sep. 27, 1984 [FR] France ..... 84 14836

[51] Int. Cl.[4] ..... H01H 85/30
[52] U.S. Cl. ..... 337/206; 337/223
[58] Field of Search ..... 337/206, 221, 189, 188, 337/222, 223

[56] References Cited

U.S. PATENT DOCUMENTS 3,286,062 11/1966 Hussar ..... 337/206
3,437,972 4/1969 Urani ..... 337/221
3,696,316 10/1972 Kitagawa et al. ..... 337/206

FOREIGN PATENT DOCUMENTS 2651552 11/1976 Fed. Rep. of Germany .
464852 4/1914 France .
2059195 4/1981 United Kingdom .

*Primary Examiner*—Harold Broome
*Attorney, Agent, or Firm*—Parkhurst & Oliff

[57] ABSTRACT

A circuit protection device, particularly for printed circuit boards, comprises a slider (25) which is held in a first operating position by fusible wire (49) extending between two pegs (19,20). The slider is propelled by a spring (48), upon fusion of the fusible wire, into a second position in which it closes a signalling circuit by means of a conductive plate (33) which comes to rest against the pegs (21,22). Means (40,41; 46, 47) is provided to prevent rebound of the plate (33) from the pegs (21,22).

11 Claims, 9 Drawing Figures

CIRCUIT PROTECTION DEVICES

BACKGROUND FOR THE INVENTION

This invention relates to circuit protection devices using fusible elements, more particularly those which are intended to be mounted on printed circuit boards with a view to protecting their electrical and electronic components, and which are of the throw-away or one way type.

Constantly increasing use of these printed circuit boards goes hand in hand with the desire for rapid, reliable identification of both the printed circuit board and of the fuse of a board whose fusible wire has acted as protection through fusion of the calibrated wire. Moreover, and particularly when they are to be used on printed circuit boards, the fuses ought to be small in terms of spatial requirements and even in terms of volume so that several printed circuit boards may be mounted side by side.

PRIOR ART

At present, the fuses used for printed circuit boards are those which are represented, by way of example, in FIGS. 1 and 2.

In the case of FIG. 1, the wires 4 and 5 are soldered to the conductive tracks 1 and 2 provided on the supporting board 3, the wires 4 and 5 being soldered onto respective covers 6 and 7 at the ends of a tube 8 in which a fusible wire, soldered to the covers at its ends is housed.

This fuse is not only fragile, but it generally comprises an opaque tube 8 so that the fusion of the fusible wire is not visible. It is possible to conceive of producing the said tube 8 with a transparent material, but research into this would only be possible with a great deal of difficulty and loss of time.

The same problems are associated with the so-called cartridge fuse represented in FIG. 2. In this embodiment, the tube 8 with a fusible wire mounted between its covers 6 and 7 is housed in a cartridge 9, the bottom 10 of which, with interior conductive wall bearing the wire 5, is to be soldered to the conductive track 1, while at the other end of the cartridge 9 a plug 11 is screwed into a thread 12 of a conductive portion 13 to which the wire 4, which is to be soldered to the track 2 of the support 3, is fixed.

This arrangement has the same disadvantage as the previous arrangement and, moreover, it is bulky.

The problem which is at the root of the invention is that of producing a circuit protection device with a fusible element, which is suitable for printed circuit boards. The device must not only be not very bulky but should also allow the faulty board and, on the board, the specific fuse, which has acted through fusion of the wire, to be pointed out at one and the same time.

SUMMARY OF THE PRESENT INVENTION

According to the present invetion there is provided a circuit protection device, particularly for printed circuit boards, comprising:

(a) a base made of an insulating material;

(b) a first pair of pins projecting from one face of the base for connection to a circuit to be protected and projecting from the other face of the case to terminate in a first pair of pegs for connection to an elongate fusible element;

(c) a second pair of pins for connection to a circuit to be controlled and terminating in a second pair of pegs;

(d) a slider which is adapted to be retained adjacent the first pair of pegs by the fusible element;

(e) resilient means acting on the slider in the direction towards the second pair of pegs;

(f) guide means provided on the base for guiding the travel of the slider;

(g) a contact plate supported by the slider and engageable with the second pair of pegs after fusion of the fusible element; and (h) co-operating means provided on the base and the slider for sensuring effective rebound—free contact between the contact plate and the second pair of pegs.

The co-operating means may be mechanical or magnetic means.

If the second pair of pegs is connected in the electrical circuit of a visual or audible signalling means, the user may indentify the faulty board immediately and by the means given below may identify the faulty fuse on the faulty board.

In a first embodiment, this arrangement is characterised in that the slider bears a contact arrangement more or less in the shape of a U, one branch of which extends crosswise in respect of the path of the slider, the bottom of which is provided with an opening used for the passage of a projection of the slider.

The transverse branch of the said contact element is provided with two lateral laminae or tongues, the projection of the slider is guided in a groove provided in the base, and the two lateral laminae arranged on both sides of the said opening are intended to be guided in the two other lateral channels of the base.

According to a variation of this, there are provided in the lateral channels stop notches which stop the two lateral tongues of the contact arrangement when the contact plate comes to bear against the second pair of pegs in a curved position between the latter.

Another embodiment is characterised in that the slider, preferably made of a ceramic material, comprises a projecting portion in the shape of a prism with a convex frontal surface over which there passes the fusible wire, a spring being braced between the face opposite the preceding one and a corresponding portion of the base.

The base advantageously comprises a wall indentical to that wall against which the spring rests. Together these two walls serve to place a cover plate in position, which cover plate serves to close the safety device, the whole being covered by a cover which is engaged by friction.

According to another embodiment, the arrangement of the invention is laid out in such a way that the cover plate and also the cover each have an opening which is disposed over the projecting portion of the slider allowing the latter to be observed when the slider is in its position, equiped with the fusible wire.

According to a variation of this, the flexible plate bears a frontal steel block opposite a permanent magnet supported by the base. The block is attracted to the magnet upon fusion of the wire to cause the contact plate to flex between the second pair of pegs.

According to another embodiment, the said means of blocking the flexible plate, which is connected to the slider, in the position in which it establishes the electrical connection between the said second pair of pegs, comprises a second spring which is separate from the one which is provided for the propulsion of the slider upon fusion of the fusible wire and which is effective in a direction which is perpendicular to the direction of the action of the propelling spring, the flexible contact plate being flexed between the second pair of pegs, under the action of the second spring, with the suppression of a locking mechanism operating with the fusion of the fusible wire.

According to another embobiment, the said blocking means comprises a casing with slits for guiding the flexible plate which is held in its position away from the second pair of pegs, against the action of the second spring, by two balls retained on a chamfer of the casing by a member which is connected to the slider and is adapted so that it may free itself of the balls upon fusion of the fusible wire when the propelling spring of the slider extends.

In a preferred embodiment in accordance with the present invention, the base is made of plastics material moulded in a square shape with small dimensions, for example, in the region of 10 mm, its height being 7 mm, for pins 4 mm long.

DETAILED DESCRIPTION OF PREFERRED EMBODIMENTS

Figure 1:
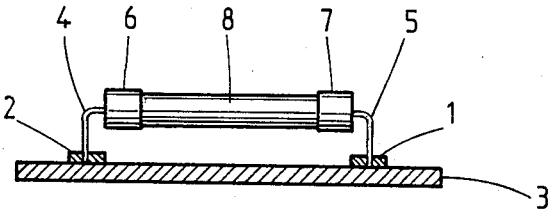
FIGS. 1 and 2 show the two arrangements already described above as the prior art.
Figure 2:
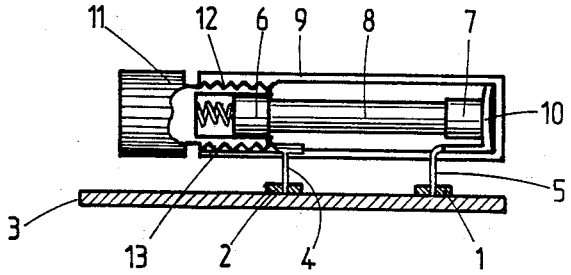
Figure 3:
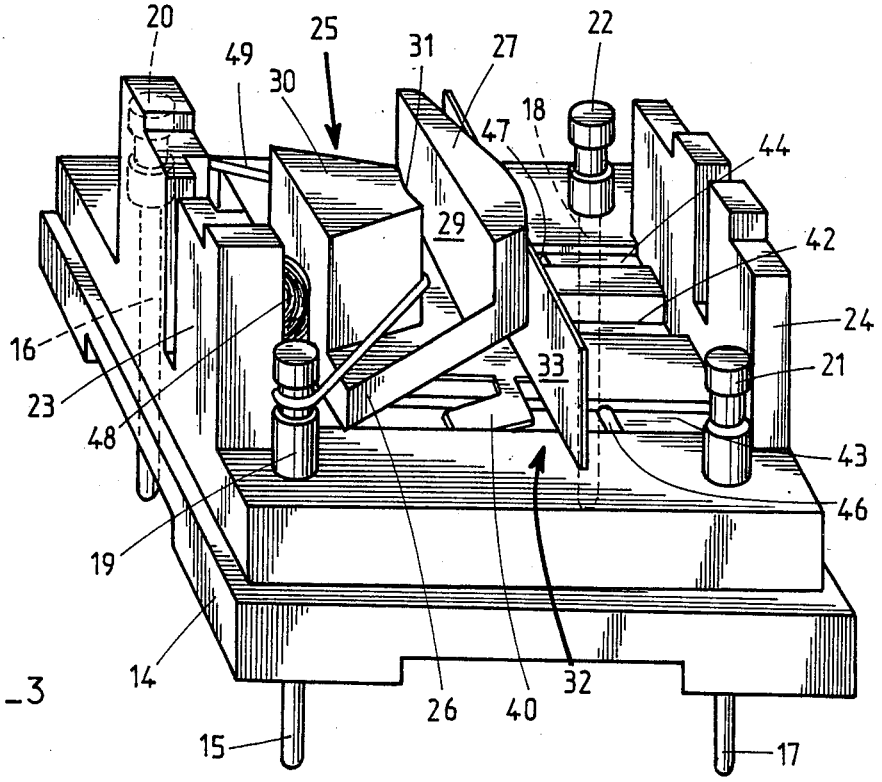
FIG. 3 is a perspective view of a fusible arrangement in accordance with the present invention.

As shown in FIG. 3, the arrangement comprises a base 14 which is made of moulded plastics material and is provided with a first pair of pins 15 and 16 and a second pair of pins 17 and 18. These pins are moulded into the mass of plastics material and are intended to be pushed into corresponding sockets provided level with the conductive tracks in question of a printed circuit board or to be soldered directly onto the tracks of the circuit to be controlled.

The pins 15, 16, 17 and 18 are provided at the upper face of the base 14 with pegs 19, 20, 21 and 22 respectively.

On the upper face of the base 14 there are provided two vertical wall elements 23 and 24 which are located respectively between the pairs of pegs 19, 20, 21 and 22, and slightly beyond the planes passing through the axes of these pairs of pegs.

A slider 25 is arranged between these wall elements 23 and 24.

This slider 25 is a ceramic element comprising a bottom portion 26 provided with a vertical wall element 27 having a convex frontal face 28 and with a plane interior face 29. At a position spaced from the face 29 the bottom portion 26 supports a generally prismatic drive block 30 the frontal face 31 of which is concave.

Figure 3A:
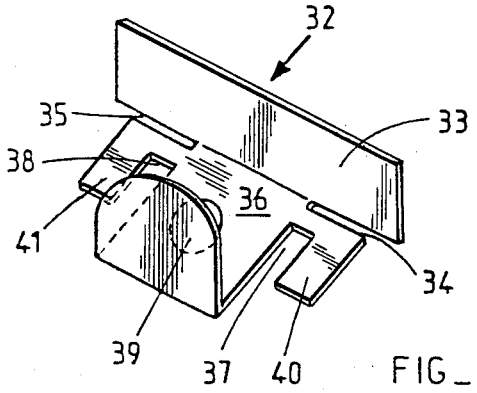
FIG. 3A is a perspective view of a contact element of the arrangement of FIG. 1.

A contact element 32 shown in FIG. 3A, is joined to the slider 25.

This contact element is made from a good conductor of electricity and is in the general shape of a U. One limb 33 of the contact element 32 forms a contact plate, whose flexibility is increased by two incisions 34 and 35 provided level with the bend formed with the bottom or transverse web 36 of the contact element 32.

With the aid of two further incisions 37 and 38 provided in the bottom of the contact element 32, two lateral tongues 40 and 41 are separated from the bottom 36 one on each side of an opening 39 which is provided there. At a position opposite the contact plate 33, the bottom portion 36 supports the other vertical limb 54 of the U-shaped contact element 32.

The contact element 32 is adapted to be fixed to the slider 25 in the manner shown in FIG. 3. The slider 25 comprises, in the lower face of its bottom portion 26, a projection which is not visible, which passes through the opening 39 of the transverse web 36 of the contact element and which extends into a central groove 42 provided in the upper face of the base 14. Two other lateral grooves 43 and 44, which are arranged one on each side of the groove 42, act as guides for the lateral tongues 40 and 41.

The slider 25 may be fitted between the contact plate 33 of the contact element 32 and its second branch 54, or the latter may even come to be lodged in a slit, which is not represented, provided in the slider 25, preferably during its production.

Finally, the grooves 43 and 44 are provided with respective stop notches 46 and 47 located at a certain distance from the pegs 21 and 22 as will be explained below in connection with the mode of operation.

A spring 48, which is preferably helicoidal, is provided between the rear face of the slider 25 and the wall element 23.

Figure 4:
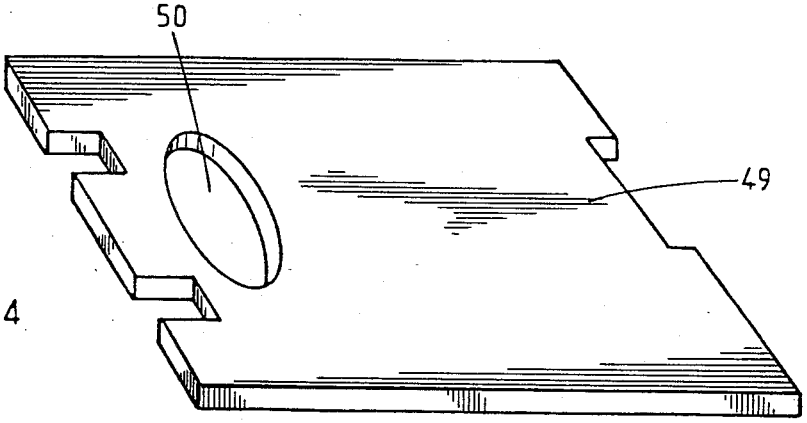
FIG. 4 is a perspective view of a lid for the arrangement of FIG. 3.
Figure 5:
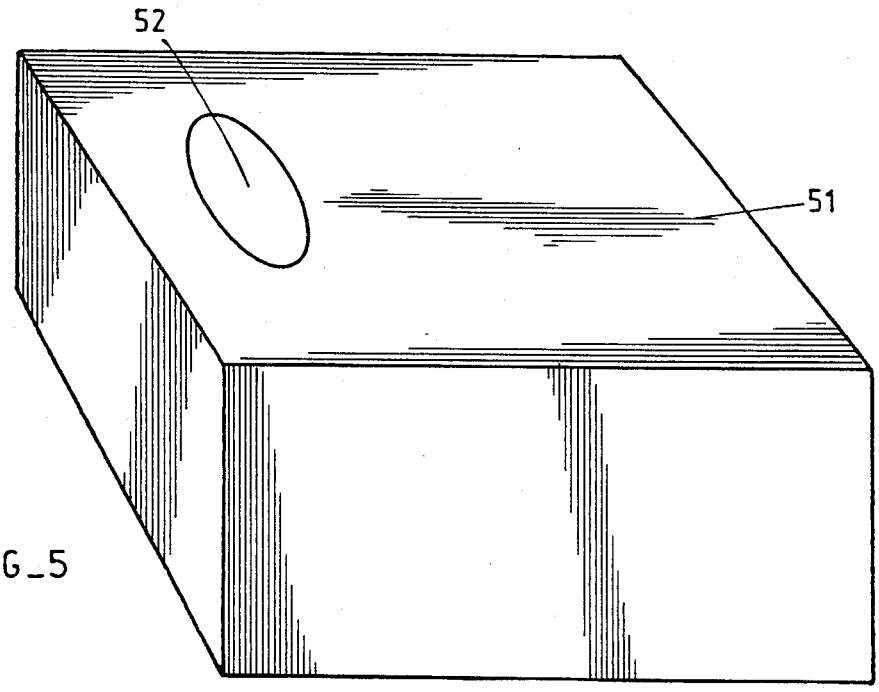
FIG. 5 is a perspective view of a cover for the arrangement of FIG. 3.

On the vertical walls 23 and 24 there is fixed a lid or closing plate 53, which is preferably made from a ceramic material and is provided with an opening 50 which is located directly above the prismatic boss 30 when the latter is in its position represented in FIG. 3. The said plate closes the cut-off device of the invention in order to prevent possible arcing which might otherwise be produced when the circuit is broken, while the whole assembly, closed in this way, is covered by a cover 51 (FIG. 4) made of moulded plastics material and comprising an opening 52 located directly above the opening 50 of the closing plate 49.

In the position represented in FIG. 3, a single or multifilament fusible wire 49 is soldered to the pegs 19 and 20 and passes over the concave face 31 of the prismatic block 30, thus holding the slider 25 in a first position in which the spring 48 is compressed.

If it is assumed that the pins 15, 16 are inserted into sockets or are soldered to the conductive tracks of a circuit, which is to be supervised, of a printed board and that the pins 17 and 18 are inserted into sockets or soldered to the conductive tracks of a signalling circuit of the same board, then in the event of fusion of wire 49, the slider 25 is propelled by the spring 48 towards the pegs 21 and 22, guided in the grooves 42, 43 and 44 by the projection which is not represented and by the tongues 40 and 41, these tongues 40 and 41 pass over the stop notches 46 and 47 as the contact plate 33 moves into contact with the pegs 21, 22 so connecting them electricially and thus completing the circuit of the conductive track of a visual or audible indicator or of a control signalling circuit of a relay allowing a cutoff or any other operating or control function.

As the contact plate 33 is brought to bear against the pegs 21 and 22, it curves between them in order to ensure a good contact which is maintained by the stop notches 46 and 47 which prevent any return of the contact plate 33 to a plane position.

In the position represented in FIG. 3, the prismatic boss 30, which may have a block of green colour, is visible, through the openings 50 and 52, and so the fusion of the wire 49 may be apparent by the absence of the boss 30 at these openings.

Thus the arrangement allows a board comprising a blown fuse and the cut-off arrangement in question to be identified at one and the same time.

If only one visible indication is desired, it is possible to dispense with the pegs 21 and 22 and the contact element 32.

Figure 6:
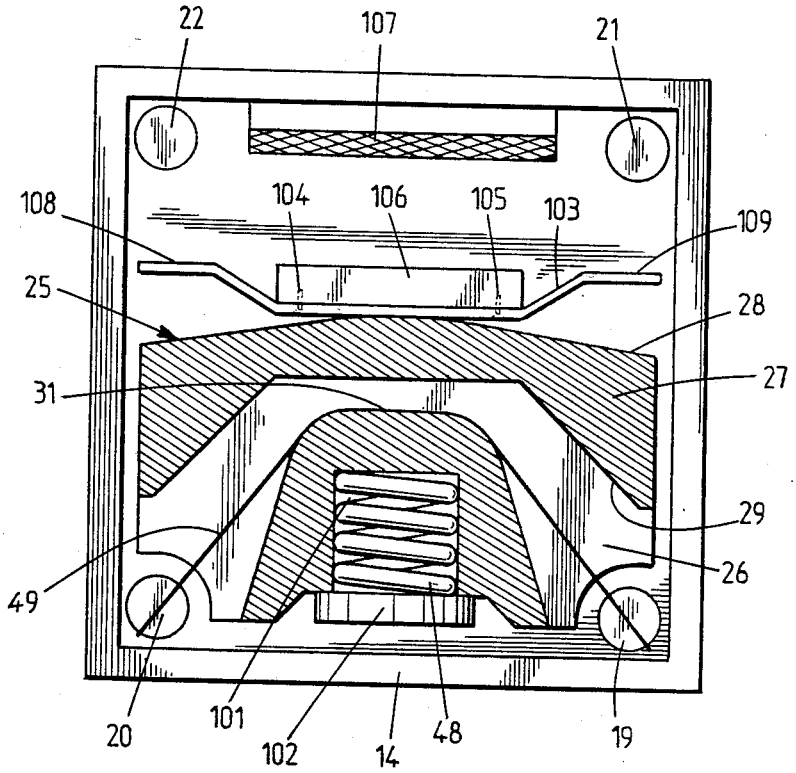
FIG. 6 is a partly sectional plan view of one modification of the arrangement of FIG. 3.

In FIG. 6, the reference number 14 again denotes the base which is made of insulating material and in which the slider 25 is provided.

The slider 25 is, as above, a ceramic element comprising a bottom portion 26 which is provided with a vertical wall element 27 with a frontal face 28 and an internal face 29, At a distance from the face 29 portion 26 bears a prismatic block, the frontal face 31 of which is concave.

The fusible wire 49 passes over this frontal concave face 31, and is hooked onto the first pair of pegs 19 and 20, thereby compressing the spring 48 which is lodged in a cavity 101 of the slider 25 and rests against a dead stop 102 supported by the base 14.

A flexible plate 103 is fixed to the frontal face 28 of the slider 25 by suitable means such as screws or rivets which are not represented. A steel block 106 is fixed to the central portion of the flexible plate 103 by means of screws or rivets 104 and 105, while opposite the block 106, the base 14 supports a permanent magnet 107 which is located between the second pair of pegs 21 and 22.

Consequently, it will be appreciated that, when the fusible wire 49 fuses, the slider 25 is propelled by the spring 48 in the direction of the pegs 21 and 22 so that the flexible plate 103 makes electrical contact between them by curving, while the steel block 106 adheres to the permanent magnet 107, this ensuring retention of the flexible plate 103 against the pegs 21 and 22 to establish good contact whilst avoiding rebounds from the pegs 21 and 22 of the flexible plate, which is preferably shaped like a basin with straightened, lateral wings 108 and 109.

Figure 8:
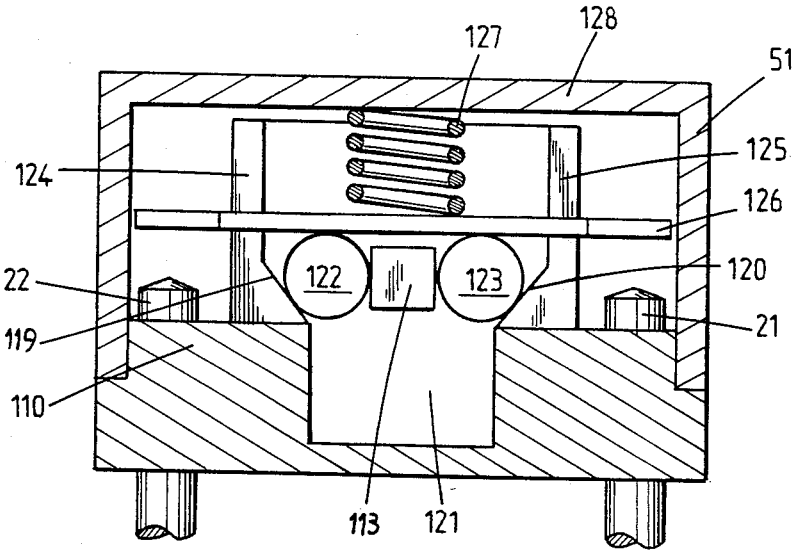
FIG. 8 is a sectional view taken on the line III—III in FIG. 7.
Figure 7:
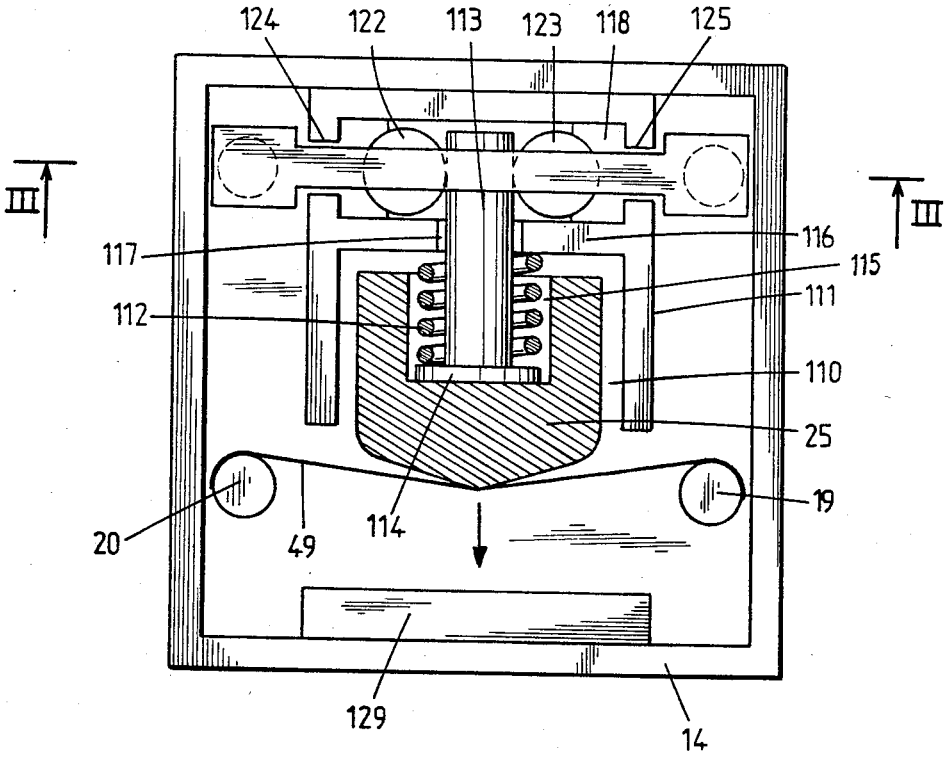
FIG. 7 is a partly sectionaly plan view of another modification of the arrangement of FIG. 3.

While in the arrangement described above the contact between the flexible plate and the second pair of pegs acts through the agency of a propelling spring of the slider and is maintained by magnetic attraction, these operations are effected in FIGS. 7 and 8 solely by elastic means, more particularly by a second spring which is provided in addition to the propelling spring of the slider.

In these Figures, the base 14 and the first pair of pegs 19, 20, and shown again. The fusible wire 49, which rests on the frontal face 31 of the slider 25, is stretched between the pegs 19, 20 and the slider 25 is mounted in a chamber 110 of a casing 111 supported by the base 14. In the state represented in FIG. 7, this slider comprises a spring 112 mounted on an axial shaft 113 supported by the slider 25 or by a piston 114 against the bottom of a blind hole 115 provided in the slider. The spring 112 abuts a transverse wall 116 of the casing 111. This transverse wall 116 has an opening 117 through which extends the axial shaft 113 which enters a second chamber 118 of the casing 111. This second chamber 118 has a bottom portion with two chamfers 119 and 120 which run into a subjacent cavity 121. Two balls 122 and 123 disposed one on each side of the axial shaft 113 connected to the slider are arranged on these chambers, the configuration of the chamfers, the diameters of the balls and the transverse section of the axial shaft being chosen so that the balls 122 and 123 are able to fall into the subjacent cavity 121 only when the axial shaft 113 moves at least partly form the second chamber.

Finally, the casing 111 comprises, in its lateral walls, two slits 124 and 125 which act as guides for a flexible plate 126 made of an electrically conductive material and extending above the pegs 21 and 22 in the position represented in FIG. 8, the plate 126 being applied against the balls 122 and 123 by a compression spring 127 which moves against the bottom of the lid 128 of the arrangement.

When the fusible wire 49 melts, the slider 25 is propelled towards a stop 129, which is supported by the base 14, under the action of the spring 112 which extends and carries along the piston 114 and its axial shaft 113. As soon as the shaft 113 leaves the second chamber 118 freeing itself of the balls 112 and 123, the latter fall into the subjacent cavity 121 and the second spring 127 extends to lower the flexible plate 126 into contact with the pegs 21 and 22, flexing between the latter under the effect of the force exerted by the second spring 127.

As pointed out above, these two pegs 21 and 22 are part of a circuit signalling the fusion of the fusible wire so that the user is able to identify quickly the faulty circuit-breaker arrangement and to replace it with a new one.

I claim:

1. A circuit protection device particularly for printed circuit boards, comprising:

a base made of an insulating material;

a first pair of pins projecting from one face of the base for connection to a circuit to be protected and projecting from the other face of the base to terminate in a first pair of pegs;

an elongate fusible element connected between said first pair of pegs;

a second pair of pins for connection to a circuit to be controlled and terminating in a second pair of pegs;

a slider which is adapted to be retained adjacent the first pair of pegs by the fusible element;

resilient means acting on the slider in the direction towards the second pair of pegs;

guide means provided on the base for guiding the travel of the slider;

a contact plate supported by the slider and engageable with the second pair of pegs after fusion of the fusible element; and co-operating means provided on the base and the slider for ensuring effective rebound—free contact between the contact plate and the second pair of pegs.

2. A device as claimed in claim 1, in which the co-operating means is a mechanical means.

3. A device as claimed in claim 1 wherein said co-operating means is a magnetic means.

4. A device as claimed in claim 1 in which the slider carries a substantially U-shaped contact arrangement having one limb which extends transversely with respect the path of the slider and a web which is provided with an opening receiving a projection of the slider, the transverse limb of the contact element being provided with two lateral tongues as cooperating means the projection of the slider being guided in a groove provided in the base and the two lateral tongues arranged one on each side of the opening being intended to be guided in two other lateral channels provided in the base.

5. A device as claimed in claim 4, in which stop notches as cooperating means are provided in the lateral channels of the base which stop notches engage the two lateral tongues of the contact arrangement when the contact plate bears against the second pair of pegs and is flexed between them.

6. A device as claimed in claim 1, in which the slider, preferably made of a ceramic material, comprises a prismatic projecting portion having a convex frontal surface over which passes the fusible wire, the resilient means being compressed between the face opposite the convex surface and a corresponding wall of the base.

7. A device as claimed in claim 6, in which the base comprises a further wall similar to the wall against which the resilient means bears, these two walls, together, serving to locate a cover plate of the device, the whole being enclosed by a cover which frictionally engage the base.

8. A device as claimed in claim 7, in which the cover plate and the cover each have an opening which is disposed over the projecting portion of the slider allowing the latter to be observed when the slider is retained in position by the fusible element.

9. A device as claimed in claim 3, in which the contact plate bears a frontal steel block disposed opposite a permanent magnet supported by the base between the second pair of pegs the steel block being attracted to the magnet upon fusion of the fusible element causing the contact plate to flex inwards between the second pegs under the action of the resilient means.

10. A device as claimed in claim 2, in which the co-operating means on the slider, in the position in which it establishes electrical connection between the second pair of pegs, comprises a second spring which is separate from the resilient means and which acts in a direction which is perpendicular to the direction of action of the resilient means, the contact plate being retained in a flexed position between the second pair of pegs by a locking mechanism displaced by the second spring upon fusion of the fusible elements.

11. A device as claimed in claim 10, in which the locking mechanism comprises a casing with slits for guiding the contact plate which is held in its position away from the said second pair of pegs, against the action of the second spring, by two balls retained on a chamfer of the casing by a member which is connected to the slider and is adapted so that it may move out of engagement with the balls upon fusion of the fusible element, under the action of the resilient means.

* * * * *

UNITED STATES PATENT AND TRADEMARK OFFICE

CERTIFICATE OF CORRECTION

PATENT NO. : 4,599,597

DATED : July 8, 1986

INVENTOR(S) : Guy ROTBART

It is certified that error appears in the above-identified patent and that said Letters Patent is hereby corrected as shown below:

On the Title Page:

In numeral [73] Assignee, change "Soremec-Chess," to --Soremec-Cehess,--.

Signed and Sealed this

Thirteenth Day of October, 1987

*Attest:*

DONALD J. QUIGG

*Attesting Officer*

*Commissioner of Patents and Trademarks*